US008130066B2

(12) United States Patent
Dunlap et al.

(10) Patent No.: US 8,130,066 B2
(45) Date of Patent: Mar. 6, 2012

(54) WIRE WINDING DEVICE FOR A HIGH POWER LEVEL TRANSFORMER

(75) Inventors: Gregory M. Dunlap, St. Charles, IL (US); Kai Chi Chan, Bloomingdale, IL (US)

(73) Assignee: Schleifring Medical Systems USA, Elgin, IL (US)

( * ) Notice: Subject to any disclaimer, the term of this patent is extended or adjusted under 35 U.S.C. 154(b) by 0 days.

(21) Appl. No.: 12/887,722

(22) Filed: Sep. 22, 2010

(65) Prior Publication Data

US 2011/0057758 A1 Mar. 10, 2011

Related U.S. Application Data

(63) Continuation of application No. 12/398,560, filed on Mar. 5, 2009, now Pat. No. 7,808,352, and a continuation of application No. PCT/US2010/035662, filed on May 20, 2010.

(51) Int. Cl.

| | |
|---|---|
| ***H01F 21/04*** | (2006.01) |
| ***H01F 27/24*** | (2006.01) |
| ***H01F 27/28*** | (2006.01) |

(52) U.S. Cl. ..... 336/115; 336/212; 336/117; 336/222

(58) Field of Classification Search ..... None
See application file for complete search history.

(56) References Cited

U.S. PATENT DOCUMENTS

| | | | | |
|---|---|---|---|---|
| 5,001,585 | A * | 3/1991 | Schalk | 360/281.5 |
| 6,388,548 | B1 | 5/2002 | Saito et al. | |
| 7,288,870 | B2 | 10/2007 | Mitcham et al. | |
| 2007/0188284 | A1 * | 8/2007 | Dobbs | 336/120 |
| 2008/0218300 | A1 * | 9/2008 | Loef et al. | 336/58 |

* cited by examiner

*Primary Examiner* — Anh Mai
(74) *Attorney, Agent, or Firm* — Cherskov Flaynik & Gurda, LLC

(57) ABSTRACT

Wire-holders are provided that confine a single wire over a limited arc section and that are interspersed with ferrite ingots that provide wire-ways for several wires are utilized in the winding of the coils of a transformer. A method for consistently producing windings having accurate wire placement on rotors, stators, and other electrical componentry is also provided.

16 Claims, 9 Drawing Sheets

WIRE WINDING DEVICE FOR A HIGH POWER LEVEL TRANSFORMER

This application claims the priority benefit of U.S. Utility application Ser. No. 12/398,560 filed on Mar. 5, 2009, currently pending. This application also claims the priority benefit of PCT Filing Serial Number PCT/US10/35662, filed on May 20, 2010, currently pending.

BACKGROUND OF THE INVENTION

1. Field of the Invention

This invention relates to an improvement in winding transformers, and more particularly, this invention relates to an improvement in the process of winding rotary transformers featuring bi-directional high level power transmission.

2. Background of the Invention

Windmills, wind turbines, and other wind-actuated power devices may utilize a rotary transformer that comprises one or more rotors and stators positioned at the top of a mast or tower. This paradigm presents special challenges. First, both the stator and especially the rotor must be small in bulk. Also, the rotor rotates at a high rate around a horizontal axis. Yet the windings of both the stator and the rotor must be able to carry large currents; thus it is imperative that effective cooling be provided thereto. Secondly, it is imperative that the rotary transformer be able to withstand extreme weather conditions.

State of the art wind turbine systems use contacting brush and slip ring mechanisms to facilitate power transfer between the stator and the rotor. These are prone to reduced reliability, frequent maintenance problems, and the generation of electrical noise that can interfere with, or damage, sensitive electronics. Oxidation and environmental agents, such as water, ice, and dust, have adverse effects on brush/slip-ring power transmission.

Replacing brush/slip-ring mechanisms with contactless configurations often ameliorate some of the problems associated with operations in environmentally-harsh situations. However, a problem inherent with contactless systems is the generation of high temperatures within the windings. This ultimately leads to reduced power output and eventually, damage to the transformer.

U.S. Pat. No. 7,288,870 (Mitcham, et al. - Oct. 30, 2007) entitled "Stator core" discloses a stator core comprising laminations of low loss stator iron positioned in parallel with laminates of high thermal conductivity material regularly arranged within the core.

U.S. Pat. No. 6,388,548 (Saito, et al. May 14, 2002) discloses a contact-less transformer that includes two disc-shaped ferrite magnetic cores, each disc comprising four quarter sections defining an arc. The quarter sections are closely mated to form the disc, whereby the arcs combine to form one or more continuous circular grooves. Windings are received within the grooves.

A problem with current winding configurations is that wire, when first placed into the grooves of carriers, tend not to stay in place. Specifically, once a wire is unwound from a supply spool and placed in a winding groove, the wire strands do not conform to the smooth curved arcs defined by state of the art winding carriers. This is so because the wire strives to maintain an arcuate shape with a radius of curvature matching that of its supply spool. Nor can the wire be consistently positioned to contact the carrier. Narrowing the winding groove does not always lead to a satisfactory arrangement inasmuch as two wires may come in contact with each other in several places. This would lead to local heat build up and electronic interference. Configuring wire ways to accept only one wire is costly and inefficient, particularly if a high number of windings is desired. Moreover, single-wire wire ways do not provide adequate flexibility when one is laying stiff wires such as the ones one often encounters in rotary transformers.

A need exists in the art for a rotary transformer to, in a contact-less configuration, transfer electrical power at levels in the 1 megaWatt range. The device must operate in extreme environmental conditions (such as high moisture, high particulate environs) and in wide ambient temperature differentials. The device must also facilitate the transfer of heat away from primary and secondary windings so as to optimize operation and longevity and therefore minimize servicing requirements. A need also exists for a manufacturing method to economically produce accurate windings consistently.

SUMMARY OF THE INVENTION

An object of the present invention is to provide a high power transformer that overcomes many disadvantages of the prior art.

Another object of the present invention is to provide a more efficient means of winding wire for rotary transformers for use in wind and water turbines, equipment, and other contact-less power transmission applications such as computer aided tomography (CAT). A feature of the present invention is a wire-holder device facilitating the encapsulation of the transformer windings with high thermal conductivity resin effective up to 500° F. An advantage of the present invention is that high power output but low-mass/low-moment-of-inertia rotors can be manufactured to accommodate rotor rotation rates in the thousands of revolutions per minute (rpm). Typical rotation rates for applications where the present invention can be put into effect include 10-300 rpm for wind turbines, 1000 rpm for jet-engine turbines and up to 20,000-30,000 rpm for high speed drills.

Still another object of the present invention is to provide a rotary transformer with increased magnetic coupling between stator and rotor. A feature of this invention is a plurality of ferrite and non-ferrite channel-ways or wire-holders removably received in annular grooves defined by opposing surfaces of the stator and rotor. The channel-ways are adapted to frictionally receive winding wire. An advantage of this invention is that the surface area of each of the channel ways facilitates heat dissipation from windings passing through the channel ways.

Another object of the present invention is to provide a rotary transformer which can accommodate power loads in excess of 1000 kilowatts by optimizing heat transfer from windings passing through a plurality of channel ways. A feature of this invention is that the channel ways are removably received in an annular groove formed in a foundation substrate of a rotor and stator, and each of the channel ways defines a chord of the arc formed by the annular grooves. An advantage of this feature is more efficient heat conduction away from each of the channel ways and therefore the windings. Another advantage of this feature is a reduction in magnetic leakage.

In brief, the present invention provides a wire-holding device for winding a transformer that facilitates the winding of single-layer resin-encapsulated stator and rotor windings. The invented transformer can accommodate power levels up to 1 megaWatt and operate typically in the 1 kW to 400 kW range. The invented rotary transformer comprises: a stationary member comprising a first mechanical carrier with first windings thereupon; a rotary member comprising a second mechanical carrier with second windings thereupon, said rotary member in registration with said stationary member;

segmented highly permeable magnetic material ingots disposed circumferentially on said carriers so as to form channels adapted to receive said windings whereby said first and second windings and said magnetic material are affixed to said mechanical carriers with a high thermal conductivity resin; and wire-holders interspersed among these ingots, said wire-holders designed to frictionally engage, and therefore maintain the position of, single wires in said windings, each wire-holder manufactured from a magnetic material ingot defining a plurality of grooves with each groove dimensioned to snugly receive a single strand of wire and further defining a ridge between grooves not higher than half the diameter of the wire.

Also, the present invention provides a method for winding rotary transformer comprising: providing a stationary member comprising a first mechanical carrier adapted to receive first windings thereupon; providing a rotary member comprising a second mechanical carrier adapted to receive second windings thereupon and providing means to place said rotary member in registration with said stationary member; providing segmented highly permeable magnetic material ingots disposed circumferentially on said carriers so as to form channels adapted to receive said windings; and providing wire-holders interspersed among these ingots, said wire-holders frictionally engaging single wires in said windings.

BRIEF DESCRIPTION OF THE DRAWING

The invention together with the above and other objects and advantages will best be understood from the following detailed description of the preferred embodiment of the invention shown in the accompanying drawing, wherein.

DETAILED DESCRIPTION OF THE INVENTION

Figure 1A:
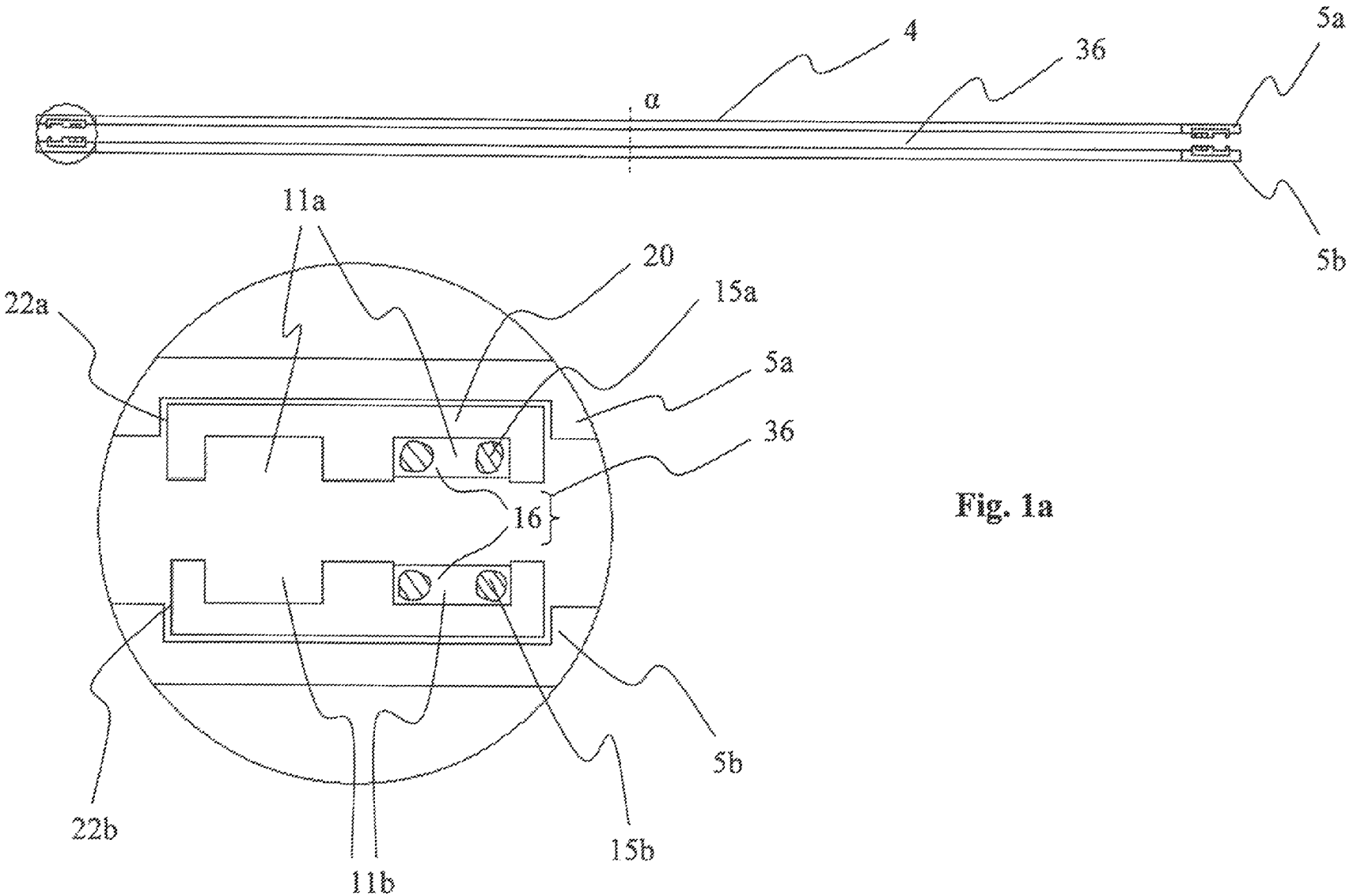
FIG. 1*a* is a schematic profile view of a rotary transformer, in accordance with features of the present invention.

The present invention provides a device and a method to be used in winding rotary transformers employed in conjunction with high power (more than 1,000 kW) electric generation and transmission, including applications involving the use of stationary or rotary transformers where power must be transferred to or from a stationary or a mobile platform (e.g. high-power transformers, motors, generators, turbines, CAT-scan devices, etc. . . ) Typically, such transformers operate at frequencies in the 500 kHz range and utilize Litz wire. The invented device comprises a wire-holder for single strands of wire that holds such wires taut, at a constant separation but in close proximity to each other so as to facilitate the winding of wire in a "pancake-type" rotary transformer. One embodiment of the invented wire-holder comprises a generally flat ingot made from magnetic material. The ingot defines a plurality of grooves or trough, with each trough dimensioned to snugly receive a single strand of wire. Intermediate the grooves is an upwardly-extending ridge having a height not more than half the diameter of the wire.

One especially important area of application of the present invention is electrical power transfer from stator to rotor for wind-power turbines. Another promising application is "micro-turbines," especially "micro-hydro turbines" that employ running water to provide power to a home or a running stream to provide power at a remote location. In general, the present invention facilitates power transfer under conditions that require the use of compact, precisely-wound rotary transformers.

A contactless power transfer system is provided comprising a primary member with strong inductive coupling to a secondary member, the combination of the two members constituting, in one embodiment, a rotary transformer having contact-less power transmission. The rotary transformer may be employed in all situations where power must be transferred to or from a mobile platform (e.g. motors, generators, wind turbines, CAT-scan devices, etc . . . ). The "rotor" may rotate at a variable frequency as high as 30,000 rpm. Both rotor and stator feature electrically conducting windings capable of sustaining high currents at high frequencies. Typical power requirements are from 1 kW to 400 kW but may comprise peaks of up to 1 megaWatt.

The high-power transfer entails high heat output with the generation of temperatures as high as 450° C. Operation with such high heat output is facilitated via heat conduction means in intimate thermal contact with the windings to conduct heat therefrom.

The invented rotary transformer can be used in conjunction with a wind turbine or a CT scanner. A rotary transformer embodying features of the present invention comprises a stationary member with windings thereupon; a rotary member with windings thereupon; whereby one or more of said windings are embedded in a high thermal conductivity resin; and inductive coupling between stator windings and rotor windings.

Figure 1B:
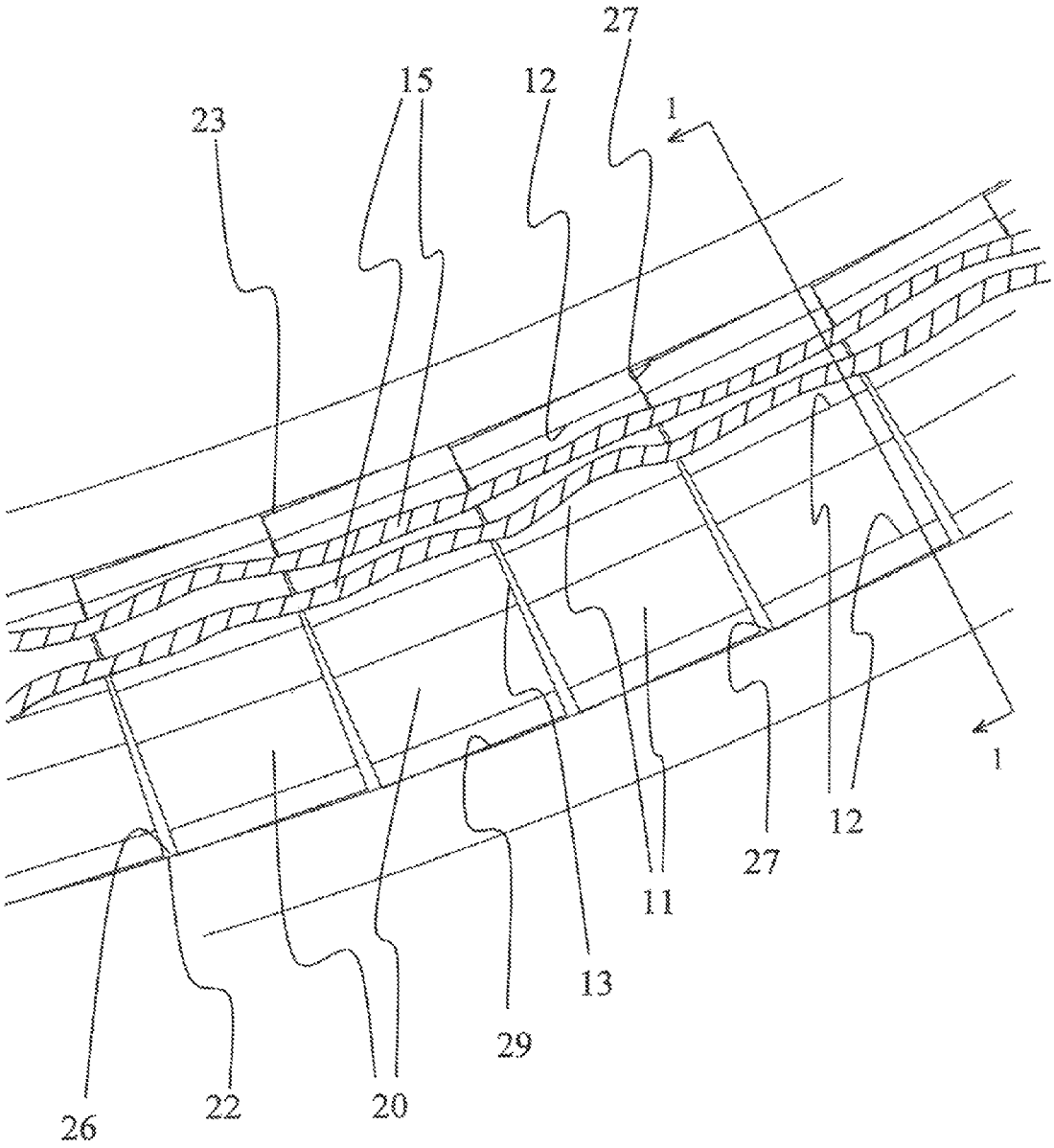
FIG. 1*b* is a schematic top view of the art winding arrangement for a rotary transformer, in accordance with features of the present invention.

FIG. 1*a* is a schematic profile view and FIG. 1*b* is a schematic top view of one embodiment of the invented rotary transformer 4. The transformer comprises two carriers 5*a* and 5*b*. A surface of each of the carriers defines annular troughs 22*a* and 22*b* such that when the carriers are mounted respectively, troughs oppose each other to define a gap 36. The annular troughs 22*a* and 22*b* receive ferrite ingots 20, such that the ingots are nested within the troughs so as not to encroach within the gap. The ingots are arranged so that their generally flat configurations are coplanar to the surface of the respective carrier supporting them. A plurality of the ferrite ingots so received by the troughs define one or more circular wire-ways 11*a* and 11*b*. Furthermore, the ingots, are loosely positioned within the troughs so as to be in slidable communication with the troughs and specifically the sides of the troughs. Therefore the ingots are in slidable communication with their respective carrier. The illustration depicts flat rectangular ingots, but other shapes are also suitable, including squares, polygons, triangles, etc.

The wire-ways 11*a* and 11*b* receive current windings comprising facing wires 15*a* and 15*b* so as to define opposing windings. The wires 15*a*, 15*b* are embedded in a high thermal conductivity resin 16. The carriers 5*a* and 5*b* rotate with respect to each other around the axis a. The closer the facing wires 15*a* and 15*b* are to each other and the larger the area the wires circumscribe, the better the performance of the transformer 4.

Figure 1C:
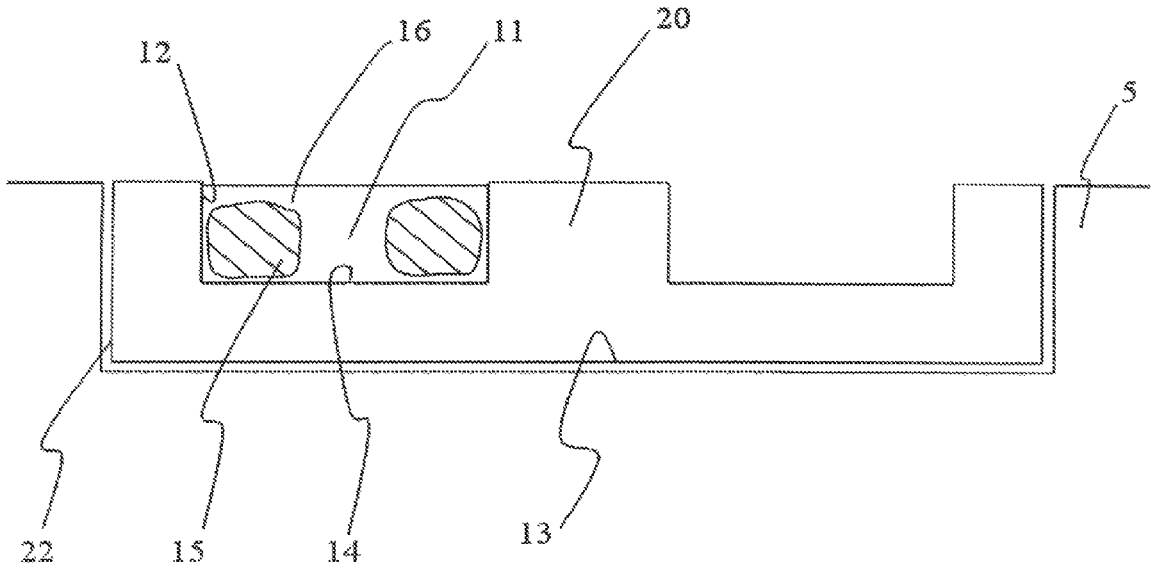
FIG. 1*c* is a view of FIG. 1*b*, taken along line 1*c*-1*c*; in accordance with features of the present invention.

As shown in FIG. 1*b*, an exemplary embodiment of the invented rotary transformer comprises one or more wire-ways, designated as numeral 11, with walls 12 and a bottom 14 (FIG. 1*c* shows a section of FIG. 1*b* taken along the line 1-1). A plurality of wires 15 are laid "parallel" to each other and to the walls 12. The power transmitted in the transformer is proportional to the number of wires 15 multiplied by the area circumscribed by a wire winding.

The wire-way 11 is defined by a sequential set of "U"-shaped ingots 20 of ferrite or of another magnetic material received in an arcuate or annular trough 22 in a carrier 5. FIGS. 1*a*-1*c* depict "E"-shaped ingots. An "E"-shaped ingot is but the junction of two "U" ingots: i.e "UU", that forms an "E" on its side. Typically, the ingots 20 are rectangular with a side 13 and a width 29, and are adapted to be received in the arcuate trough 22. The ingot wire-way walls 12 are perpendicular to the ingot sides 13. When the ingots 20 are laid in the arcuate trough 22, there are triangular interstitial spaces 26 left between the sides 13 of two neighboring ingots 20 and the trough wall 27 as well as arcuate shaped spaces 23 between the ingots 20 and the trough wall 27.

Figure 2A:
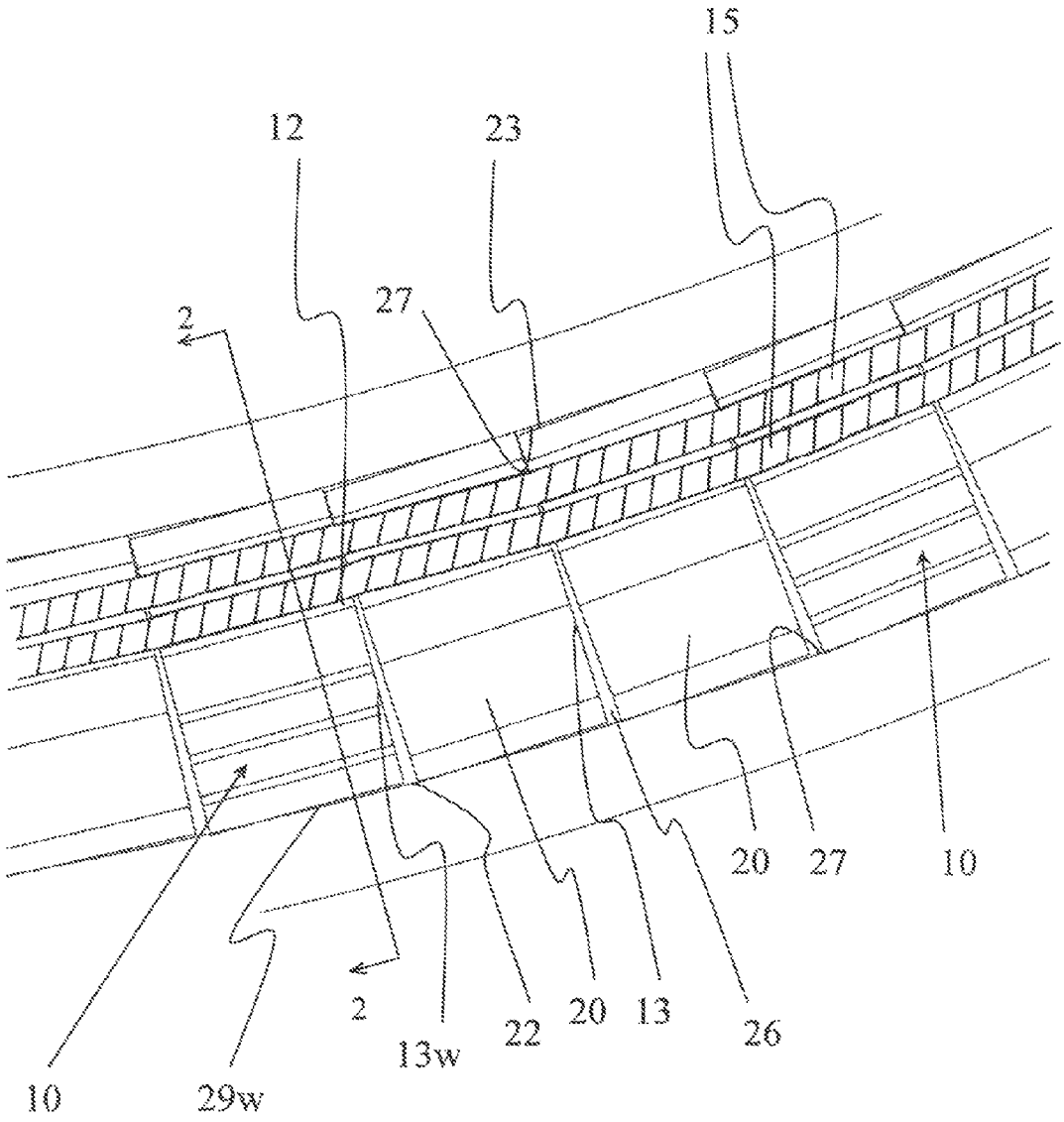
FIG. 2*a* is a schematic top view of a winding tensioner for a rotary transformer, in accordance with features of the present invention.

FIG. 2*a* shows a winding arrangement where invented wire-holders 10 are interspersed among the ingots 20, such that the wire holders either flank the ingots, or are flanked by the ingots. In one embodiment, the wire holders are all that are found in the troughs, with no ingots in the trough. In another embodiment, a plurality of ingots are positioned intermediate two wire holders, such that the plurality of ingots are flanked by the wireholders. In still another embodiment of the invention, a single ingot is placed next to a single wireholder and this sequence repeats itself along the entire trough or along a predetermined region of the trough.

The wire-holders 10 ensure that at regular intervals along the arcuate trough 22 neighboring wires 15 maintain a constant distance from each other as well as from the walls 12 and bottoms 14 of the wire-ways 11 in the ingots 20. The wire-holders 10 have a rectangular base and are dimensioned with sides 13*w* and widths 29*w* comparable to the sides and widths of the ingots 20 so as to be snugly received within the carrier troughs 22. The interaction of the rectangularly-shaped wire-holders with the arcuate-shaped troughs that have no rectilinear sections results in a frictional engagement of the wire-holders with the troughs thus providing a means for removing slack in the wires 15. (See FIG. 3*b*). For example, such frictional engagement allows a wire-holder to be inserted in a trough 22 and rotated in the trough around an axis perpendicular to the plane of the carrier. This allows grooves 44 in the wireholder to be slightly misaligned with the wire-ways 11 of adjacent ingots thus pinching or otherwise hindering the wire.

Figure 2B:
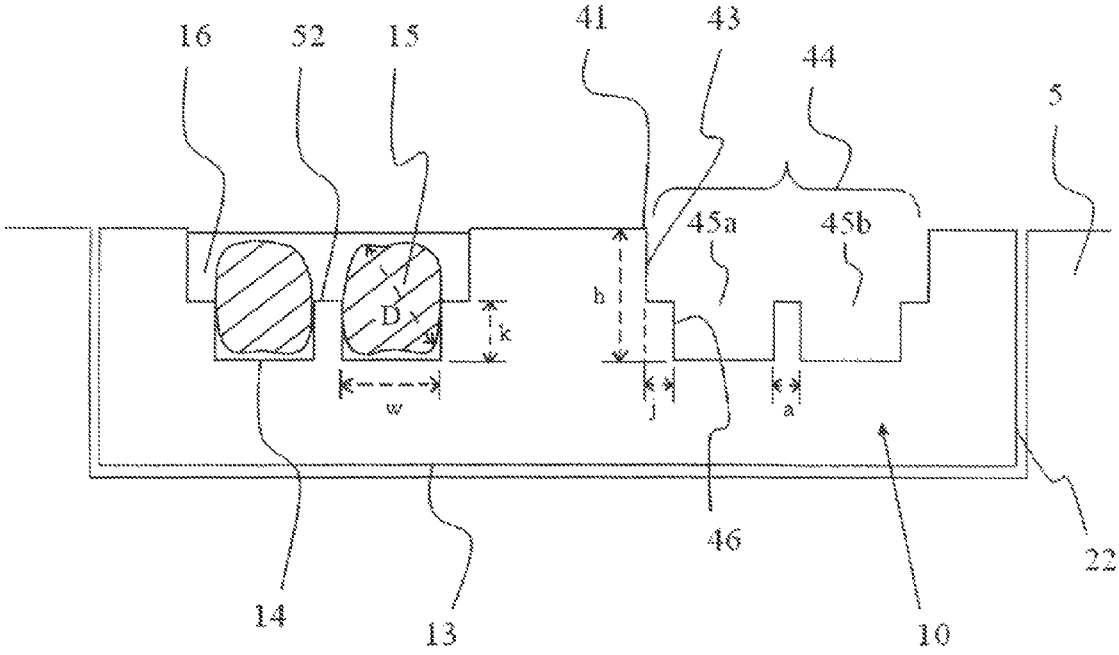
FIG. 2*b* is a view of FIG. 2*a* taken along line 2-2, in accordance with features of the present invention.

FIG. 2*b* is a profile view taken along lines 2-2 of FIG. 2*a* of an invented wire-holder in accordance with features of the present invention. The wire-holder depicted in FIG. 2*a* is adapted to be used with "E" shaped ingots. The invented wire-holder must be designed for wire of a specific diameter D. Commonly available Litz wire has a diameter of 4.57 mm±0.20 mm. Of necessity, for such wire D must be taken to be 4.77 mm. (Actually, Litz wire has an irregular cross-section that can be approximated to be a circle.) The wire-holder 10 comprises a plurality of grooves 44 each groove comprising two or more sub-grooves 45*a*, 45*b*, 45*c*, etc. . . . so that a wire 15 fits snugly into and remains in frictional engagement with a sub-groove, with the width w of a sub-groove approximately equal to 1.02×D of the wire 15. As depicted in FIG. 2*b*, the wire tends to have an irregular cross-section so that there may be air gaps between the snugly held wire 15 and the wire-holder groove 45.

Sub-grooves are separated by ridges 52 of height k as measured from the bottom 14 of the sub-groove (with k approximately equal to half of D for the wire) and width a (with a approximately equal to 0.3 D). The groove 44 has upwardly-extending walls 43 so that the rim 41 of the groove 44 rises a distance h above the floor 15 of the groove, where h is approximately equal to 1.12D. Given the reliance on frictional engagement the maximum error allowable for all of the above dimensions is ±0.03D. The walls 43 have medially-directed ledges 46 that project at a distance j from the walls 43, with j being less than or approximately equal to 0.3D.

The fact that the height k of the ridges 52 is less than the diameter D of the wires 15 has the advantage that the ridge is shielded from impact (ferrite is a rather brittle material). Also, this lower height k allows more thermally conductive epoxy to come into contact with the wire. The lower height for k allows the width a of the ridge to be rather thin so that a large number of wires 15 can be laid next to each other, as far away from the carrier axis axis $\alpha$ as possible and with a constant distance separating these wires so as to minimize heat and magnetic induction transfer between neighboring wires.

As is shown in FIG. 2*b*, the wire 15 is selected so as to engage the wire holder 10 therefore, allowing the wire 15 to remain in place during the winding process. While in some embodiments Litz wire is used, other types of wires are employed in other embodiments. For instance, while the wire as depicted in FIG. 2*b* has a somewhat rectanirregular cross-section. Surprisingly and unexpectedly, the inventors found that, a wire having a square or rectangular subsection, or a substantially square or rectangular subsection, may also be employed. This shape maximizes wire surface area contact with interior regions of the ingot. In one embodiment, a wire 15 having a rectangular cross-section is used wherein the cross section defines substantially 90 degree corners. The 90 degree corners of the wire 15 engage the corners of each sub-groove 45*a* and 45*b*. The width w of each sub-groove is approximately equal to, or slightly larger than (e.g. 1.02 times W1), the width of the wire so as to facilitate friction fit of the wire in the subgroove. In another embodiment, both the width and the height of the wire are nearly identical, forming a wire having a square-cross section. A wire having such a square cross-section will be easier to install in that any face of the wire may be inserted into the sub-groove.

Figure 1D:
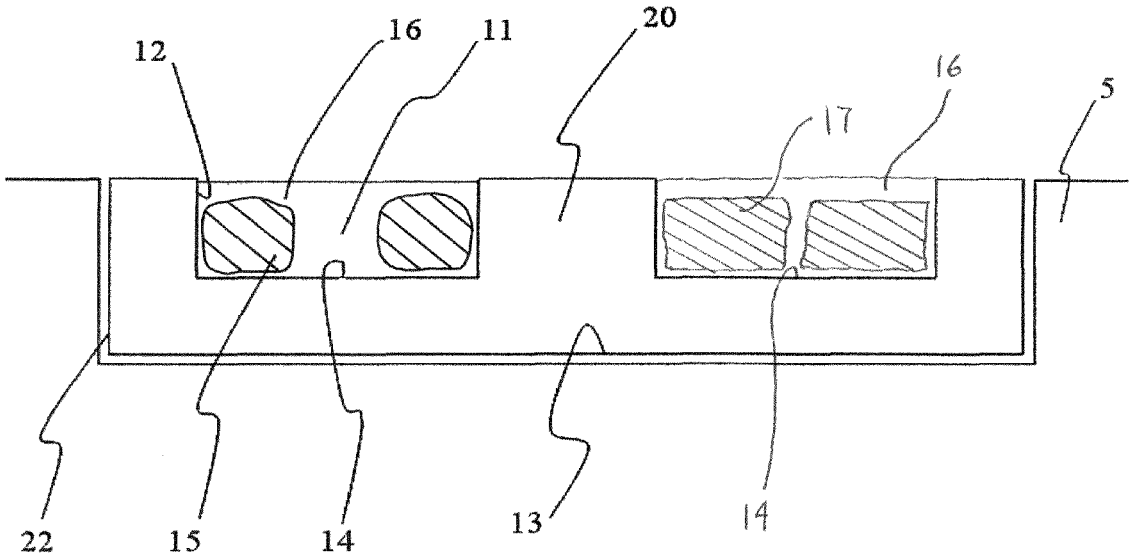
FIG. 1*d* is a view of FIG. 1*b*, taken along line 1*c*-1*c*; in accordance with features of the present invention.

In an embodiment of the invention, and as depicted in FIG. 1*d*, rectangular wires only 17 (and not round-wires) are provided and arranged within the ingots 20 such that the widest side of the wires contact the floor or bottom 14 of the ingot. This assures that the wires, despite the large current density conferred by their large wire cross section, remain below the surface of the ingots. This further assures that an opposite side of the widest side, also equally wide, faces outwardly to oppose the windings of the opposing wire carrier. While FIG. 1*d* depicts the rectangular wires situated in an ingot depression not defining a subgroove and midwall 52, use of the rectangular wires with such a subgroove as depicted in FIG. 2*b* is envisioned. Exemplary rectangular wires are commercially available from New England Wire Technologies, Lisbon, N.H., as 2 BAWG Litz wire with square jacket.

Figure 2C:
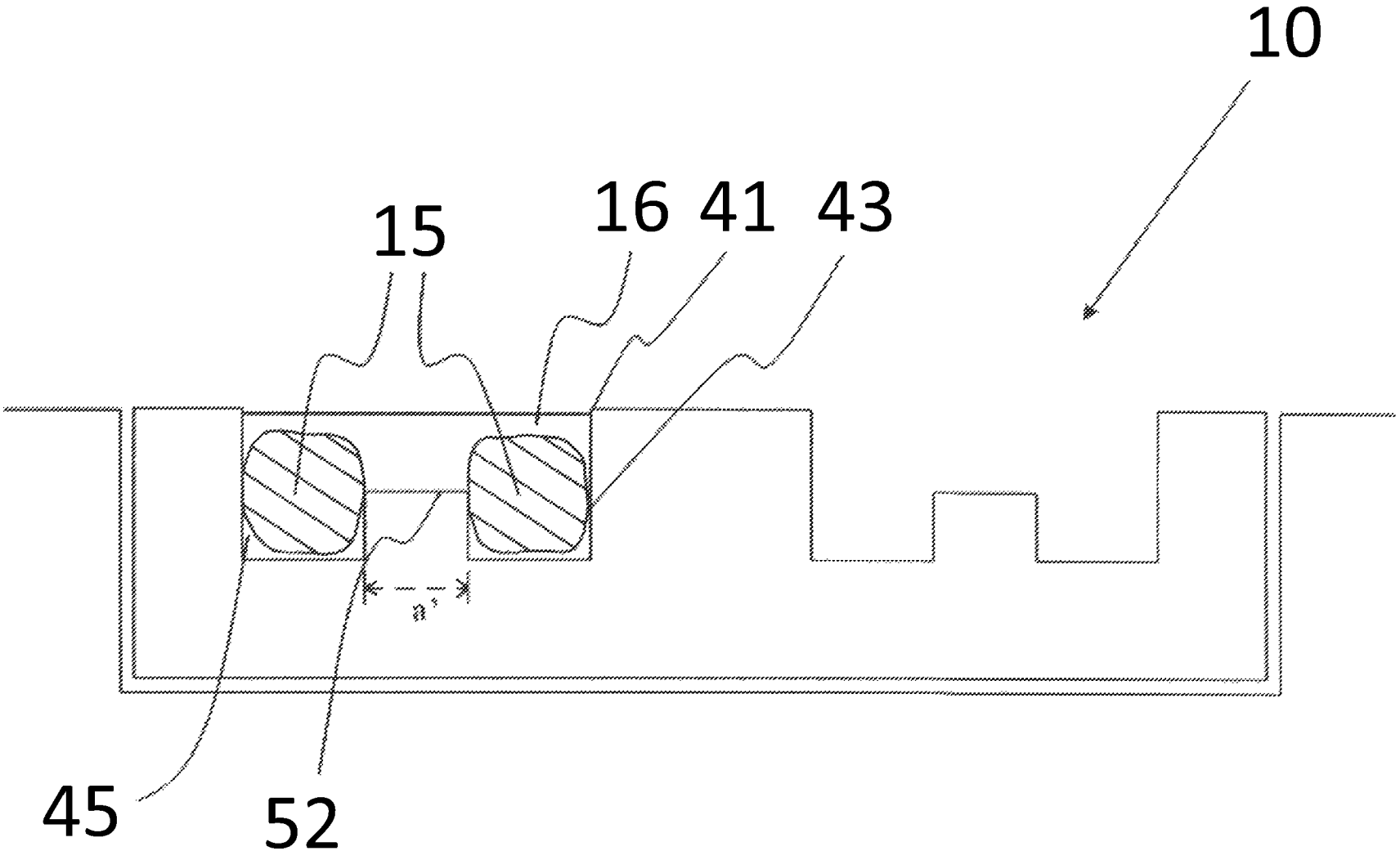
FIG. 2*c* is an elevational profile view of an alternative embodiment for a wire-holder in a winding arrangement for a rotary transformer, in accordance with features of the present invention.

FIG. 2*c* is a profile view of an alternative embodiment of the invented wire-holder. In this alternative embodiment the ledges 46 have been eliminated while the ridges 52 have a width a' equal to approximately 0.85 D.

It can be appreciated that in the embodiment depicted in FIG. 2*b* more heat-conducting resin 16 can conduct heat from with the wires 15 to the walls 43 than in the FIG. 2*c* embodiment. This is so because an entire half circle of the wire periphery is overlaid with high thermal conductivity resin. The specific numeral dimensions indicated above are presented for illustrative purposes, different diameter wire will require differently dimensioned grooves. However, the aforementioned ratios are suitable for most wire sizes.

A low magnetic reluctance is necessary to accommodate the high-frequency induced magnetic field produced by the high frequency currents often used in rotary transformers. Generally, any soft material with a high saturation flux density, a high permeability, and stable temperature characteristics is suitable. Suitable low magnetic reluctance materials include ferrites, nickel, nanocrystallines, and powdered iron. Nanocrystalline iron-based soft magnetic material is particularly suitable and commercially available. Fore example, FINEMET® developed by Hitachi Metals is especially suitable. FINEMET® is obtained by rapid quenching of a molten metal mixture consisting of Fe, Si, B, and small amounts of Cu and Nb. These alloys have crystals which are extremely uniform and very small, approximately 10 nm in size. The use of nanocrystalline ferrous-based materials allows a reduction in the bulk and weight of the transformer components.

Ferrites are especially advantageous in this application because of their low mass density and low magnetic reluctance. Ferrites are dense, homogeneous ceramic compounds composed mainly of iron oxide ($Fe_2O_3$) and carbonates of metals such as magnesium, zinc, nickel, or manganese. The mixture is pressed and then fired in a kiln.

Nickel is another material possessing low magnetic reluctance. Nickel has the advantage of being slow to react in air at normal temperatures.

Ingot/Wire-Holder Interaction Detail.

The invented wire-holder 10 that removably restrains single wires in place is intended to be interspersed with ingots 20 that define a wire-way wherein several wires are contained alongside one another. It is suggested that the optimal configuration is where there is a ratio of two or three ingots 20 for each wire-holder 10. To best prevent air gaps between wire and ferrite grooves it is recommended that a small amount of epoxy be poured into the grooves before wire is laid out.

Figure 3A:
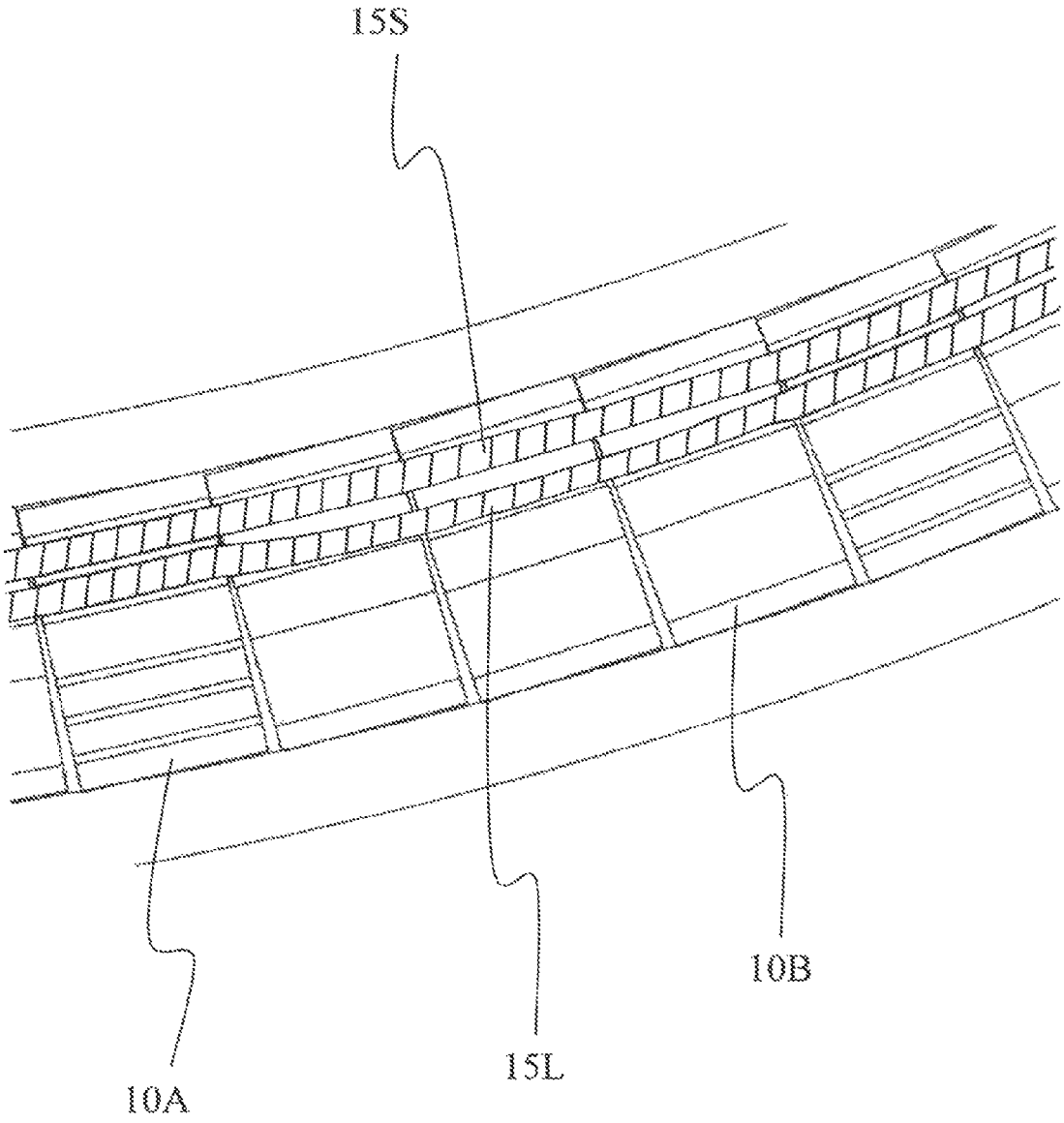
FIG. 3*a* is a top schematic view of a wire-holding winding device for a rotary transformer, in accordance with features of the present invention.

When wire is laid out from a spool, it is too stiff to be laid out in perfect circles. As such, one may have an excessive length of wire at some points and a deficit of wire at other points (both these situations are depicted schematically in FIG. 3*a*, with 15L representing the wire that is too long and 15S the wire that is too short. One can appreciate from FIG. 3*a* the distinct advantage of having the wires 15L and 15S constrained at a finite number of points rather than along their whole lengths. If wire-holders 10A and 10B in FIG. 3*a* are separated by an arc of radius R subtending an angle θ measured in radians so that the length of the arc Rθ, the wire 15*s* will be accepted by the wire-holders 10A and 10B provided wire 15*s* is longer than 2Rsin(θ/2).

Figure 3B:
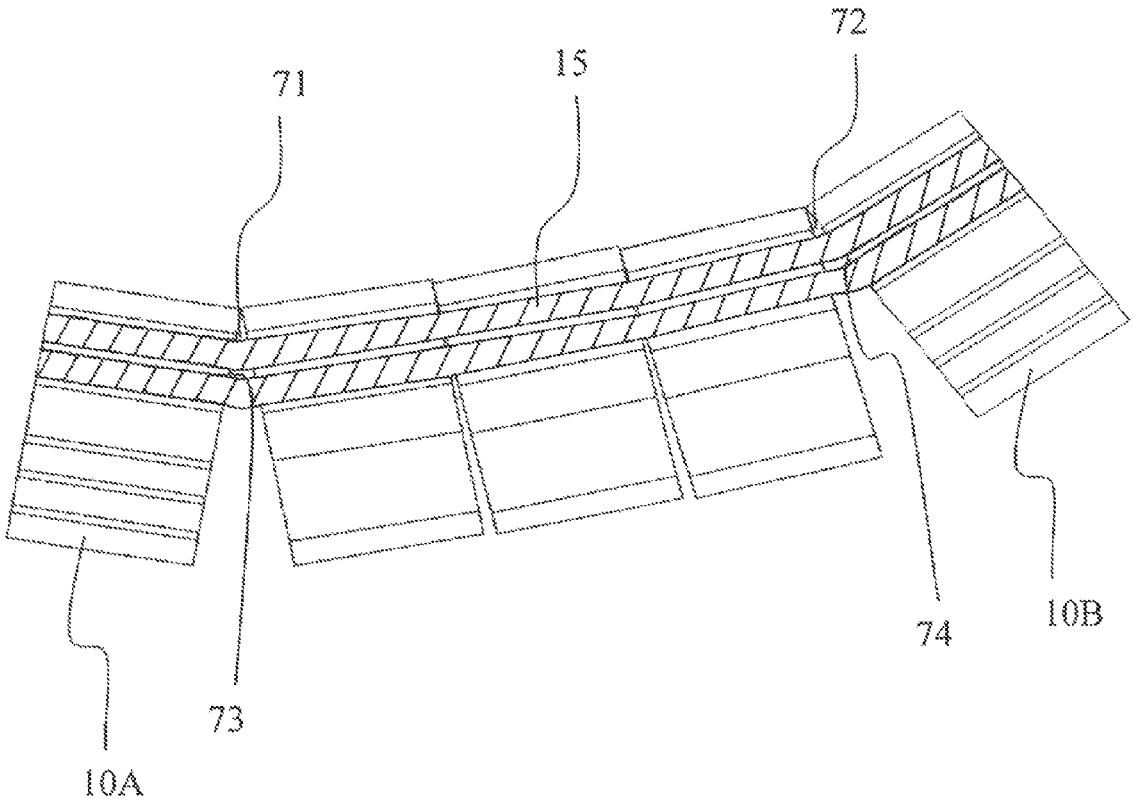
FIG. 3*b* is a top schematic view of an alternative embodiment of a wire-holding winding device for a rotary transformer, in accordance with features of the present invention.

FIG. 3*b* depicts another advantage of the present invention. As noted supra, a rectangular-base wire-holder received in an arcuate trough has a certain amount of rotational freedom. In FIG. 3*b*, two successive wire-holders 10A and 10B are rotated so that their facing extremities 71, 72 are bought somewhat closer to each other. Thus the distance between egress point 73 from wire-holder 10A for the wire 15 and the ingress point 74 in wire-holder 10B is somewhat shorter than the distance corresponding to the arc suspended by the two wire-holders. (For purposes of clarity, FIG. 3*b* is exagerated). [In general, given two points x,y separated a distance s along a circular arc of radius R, then the angle subtended by that arc is R/s and then the straight-line distance between x and y is 2Rsin(R/s).]

The invented configuration differs from prior art reciting two magnetic cores, each core comprising one or more continuous circular grooves. In such an arrangement it is not possible to adjust the configuration of the grooves so as to compensate for variations in the tension and orientation of the wire as it is unwound from a spool. Also, the invented wire-holder differs from prior art that recites a wire-holding harness that is used to adjust the length of wires as they are being laid out but where the harness is removed once the wires are attached in place.

High Power Operation

A corollary of contact-less power transmission is contact-less cooling of the rotor, which in turn requires efficient heat transfer from the current-bearing windings of the rotor to the ambient atmosphere. Efficient heat transfer from the current-bearing windings of the stator to the ambient atmosphere is also required. Ferrites, or other suitable low magnetic reluctance materials, are often used for the rotor and/or the stator and these must be kept at a temperature of less than 180° C. in order to prevent a drop in the magnetic permeability of the material.

In an embodiment of the present invention, current-bearing windings are nested in annular grooves having an "E"-shaped cross section as depicted in FIG. 2*b* and FIG. 2*c*. The "E"-shape allows better containment of stray magnetic fields in the vicinity of the windings. The windings are coated with the same high thermal conductivity epoxy resin 16 as that used to hold the ingots and wire-holders in the troughs 22. One suitable commercially available resin is Durapot 865 available from Cotronics Corporation of Brooklyn, N.Y. This arrangement allows rapid heat transfer from the windings to the rotor whence heat is transferred to the atmosphere by air currents convection.

Preferably, the wire windings consist of 'Litz' wire. Litz wire is especially advantageous because of the high frequency power often employed with rotary transformers in such applications as CAT devices and wind turbines. Litz wire consists of a braid of many thin wires, individually coated with an insulating film and twisted together following a carefully prescribed pattern designed to minimize the additional alternating current resistance caused by the 'skin effect' and the 'proximity effect.' The 'skin effect' refers to the tendency of a high frequency alternating electric current to distribute itself within a conductor so that the current density near the surface of the conductor is greater than that at its core. Thus the effective resistance of the conductor increases with the frequency of the current.

The 'proximity effect' refers to the fact that an alternating magnetic field is produced by an alternating current flowing through an isolated conductor and that this alternating magnetic field in turn induces eddy currents within adjacent conductors, altering the overall distribution of current flowing through them.

Wire is laid in a groove so that the top of the wire is below the rim of the groove. In an embodiment of the invention, Litz wire is laid in the groove so that the top of the winding is below the rim of the ferrite core, such as 0.078 mm below the rim of the ferrite core. As depicted in FIG. 2*b*, wires 15 are laid one layer thick inside a groove. This arrangement allows much stronger magnetic coupling between primary and secondary windings by minimizing magnetic leakage and much more efficient heat transfer from the windings by maximizing the surface area of the winding. The total ohmic resistance of a winding 15 is 0.01 Ohm. While still liquid, epoxy is poured in the groove so that it submerges the wire but remains below the rim of the groove.

Resin Detail:

Generally, any resin which has a very high thermal conductivity (above 8 (BTU-in/hr°Fft$^2$)), low magnetic reluctance, and very high electrical resistivity ($11^{16}$ ohm.per cm or above) is suitable. This resin serves to provide insulation between the wires comprising each of the windings. For example, Durapot has a thermal conductivity of 20 (BTU-in/hr°Fft$^2$). Its formulation is based on Novolac resin and Amine hardener.

Typically, epoxy resins have other advantages, including a low thermal expansion, $4.5\times11^{-5}$/° C.; the ability to withstand temperatures higher than 200° C.; and a melting point for the fully cured epoxy of 250° C.

A resin with a very high thermal conductivity is also used in assembling the ferrite cores that are used in constructing the rotor and the stator.

The inventors have found that high thermal conductivity epoxy resins allow the construction of a rotor with an outer area of less than 1 square meter carrying a steady state current as high as 1100 Amperes and dissipating 11 kWatts of thermal energy, i.e. a rate of heat dissipation of 11 kWatts/square meter and a stator with an outer area of less than 1 square meter carrying a current as high as 1100 Amperes and dissipating 11 kWatts of thermal energy, i.e. a rate of heat dissipation of 11 kWatts/square meter.

Using the high thermal conductivity epoxy resin one can achieve power transfer levels above 110 kWatt, otherwise one cannot go beyond 20 kW.

While the invention has been described with reference to details of the illustrated embodiment, these details are not intended to limit the scope of the invention as defined in the appended claims.

The embodiment of the invention in which an exclusive property or privilege is claimed is defined as follows:

1. A plurality of wire-holders to be incorporated into a transformer winding, each wire-holder comprising a magnetic ingot defining a plurality of grooves, such that the grooves form wireways when the plurality of grooves is received by an annular channel located on a plater defining a winding carrier of the transformer, where each wireway is adapted to receive wire, wherein the ingot have a rectangular shape and is received by the annular channel such that there are triangular spaces between the sides of adjacent ingots.

2. The wire holder as recited in claim 1 wherein the wire has a rectangular cross section.

3. The wire-holder as recited in claim 1 wherein said wireways define grooves having a depth equal to approximately 1.12 times the diameter of the wire.

4. The wire-holder as recited in claim 3 wherein said grooves have walls with side ledges as high as half the wire diameter.

5. A rotary transformer comprising:

a) a stationary member comprising a first mechanical carrier with first wire windings thereupon;

b) a rotary member comprising a second mechanical carrier with second wire windings thereupon, said rotary member in registration with said stationary member;

c) highly permeable magnetic material ingots disposed circumferentially on said carriers so as to form wireways adapted to receive said windings wherein the ingots have a rectangular shape and are received in troughs defined by said carriers such that there are triangular spaces between the sides of adjacent ingots and, whereby said first and second windings are affixed to said magnetic material ingots with a high thermal conductivity resin.

6. The transformer as recited in claim 5 wherein the resin substantially submerges the windings.

7. The transformer as recited in claim 5 wherein the wires have a rectangular cross section.

8. The transformer as recited in claim 5 including means to adjust the ingots to allow adjustment of the length of wire held between ingots.

9. The transformer as recited in claim 5 wherein all the ingots are wire-holders which frictionally engage the wires.

10. The transformer as recited in claim 5 wherein the ingots are adapted to frictionally engage the wires.

11. A method for manufacturing a rotary transformer comprising:

a) providing a stationary member comprising a first mechanical carrier and winding first wires thereupon using segmented highly permeable magnetic ingots disposed circumferentially on said carrier so as to form wire-ways adapted to receive said wires, with wire-holder segments adapted to receive and hold single wires interspersed among said ingots;

b) providing a rotary member comprising a second mechanical carrier and winding second wires thereupon, said rotary member being placed in registration with said stationary member, c) using segmented highly permeable magnetic ingots disposed circumferentially on said carrier so as to form wire-ways adapted to receive said wires; and d) affixing said first and second windings to said magnetic material, wherein the ingot has a rectangular shape and such that there are triangular spaces between the sides of adjacent ingots.

12. The method as recited in claim 11 further comprising wire holder segments adapted to receive and hold single wires interspersed among said ingots and wherein the wire-holder segments position the wires in a predetermined configuration prior to the addition of the resin.

13. The method as recited in claim 11 wherein some of the wires have rectangular cross sections.

14. The method as recited in claim 11 further comprising substantially submerging the windings with a resin.

15. The method as recited in claim 14 wherein said ingots are wire-holder segments, which are adapted to receive and hold wires, to position the wires in a taut configuration.

16. The method as recited in claim 11 wherein some of the ingots are rectangular in shape.

* * * * *